United States Patent [19]

Goutzoulis

[11] Patent Number: 4,704,702

[45] Date of Patent: Nov. 3, 1987

[54] SYSTOLIC TIME-INTEGRATING ACOUSTO-OPTIC BINARY PROCESSOR

[75] Inventor: Anastasios P. Goutzoulis, Forest Hills Boro, Pa.

[73] Assignee: Westinghouse Electric Corp., Pittsburgh, Pa.

[21] Appl. No.: 739,419

[22] Filed: May 30, 1985

[51] Int. Cl.[4] ..... G06G 9/00; G06G 7/195

[52] U.S. Cl. ..... 364/841; 364/822; 364/606

[58] Field of Search ..... 364/822, 841, 845, 713, 364/606; 350/96.14, 162.12

[56] References Cited

U.S. PATENT DOCUMENTS

| | | | |
|---|---|---|---|
| 3,588,486 | 6/1971 | Rosen et al. | 364/845 |
| 3,872,293 | 2/1975 | Greeh | 350/162.12 X |
| 4,003,642 | 1/1977 | Vogeley | 351/216 |
| 4,009,380 | 2/1977 | Bocker et al. | 364/837 |
| 4,225,938 | 9/1980 | Turpin | 364/822 |
| 4,286,328 | 8/1981 | Bocker | 364/822 X |
| 4,566,077 | 1/1986 | Schüocker et al. | 364/841 X |
| 4,567,569 | 1/1986 | Caulfield et al. | 364/841 X |
| 4,569,033 | 2/1986 | Collins et al. | 364/845 |
| 4,588,255 | 5/1986 | Tur et al. | 350/96.16 |
| 4,592,004 | 5/1986 | Bocker et al. | 364/845 X |
| 4,595,994 | 7/1986 | Verber et al. | 364/841 |
| 4,603,398 | 7/1986 | Bocker et al. | 364/841 X |
| 4,607,344 | 8/1986 | Athale | 364/822 X |
| 4,608,569 | 8/1986 | Dickey et al. | 342/384 |
| 4,633,428 | 12/1986 | Bryon | 364/841 X |
| 4,667,300 | 5/1987 | Guifoyle | 364/841 X |

OTHER PUBLICATIONS

Goutzoulis, A. P., "Systolic Time-Integrating Acoustooptic Binary Processor," Applied Optics, vol. 23, No. 22, Nov. 15, 1984, 4095–4099.

R.P. Bocker et al., "Electrooptical Matrix Multiplication Using the Twos Complement Arithmetic for Improved Accuracy" Applied Optics, vol. 22, No. 13, Jul. 1, 1983, 2019–2021.

*Primary Examiner*—Jerry Smith
*Assistant Examiner*—Charles B. Meyer
*Attorney, Agent, or Firm*—W. G. Sutcliff

[57] ABSTRACT

An optical processing system performs matrix-matrix, matrix-vector, and vector-vector multiplication. Element product formation is accomplished by the time integration of a detector array which converts light signals into electrical signals. Inner products are formed by the spatial integration of a cylindrical lens which focuses modulated light onto the detector array. Modulation of the light is accomplished by bit-serial modulation of the light sources with one element value in twos complement form, and by bit-serial modulation of an acousto-optic cell by the other element value in twos complement form. A multi-channel systolic embodiment permits a complete vector quantity formation without the need to enter modulation data separately for each inner product of the vector.

11 Claims, 6 Drawing Figures

| | | | | | | | | | | | | |
|---|---|---|---|---|---|---|---|---|---|---|---|---|
| (+13) | 0 | 0 | 0 | 0 | 0 | 0 | 0 | 1 | 1 | 0 | 1 | ← 10 |
| (−45) | 1 | 1 | 1 | 1 | 1 | 0 | 1 | 0 | 0 | 1 | 1 | ← 12 |
| | 0 | 0 | 0 | 0 | 0 | 0 | 0 | 1 | 1 | 0 | 1 | |
| | 0 | 0 | 0 | 0 | 0 | 0 | 1 | 1 | 0 | 1 | | |
| | 0 | 0 | 0 | 0 | 0 | 0 | 0 | 0 | 0 | | | |
| | 0 | 0 | 0 | 0 | 0 | 0 | 0 | 0 | | | | |
| | 0 | 0 | 0 | 1 | 1 | 0 | 1 | | | | | |
| | 0 | 0 | 0 | 0 | 0 | 0 | | | | | | |
| | 0 | 1 | 1 | 0 | 1 | | | | | | | |
| | 1 | 1 | 0 | 1 | | | | | | | | |
| | 1 | 0 | 1 | | | | | | | | | |
| | 0 | 1 | | | | | | | | | | |
| | 1 | | | | | | | | | | | |
| (−585) | 3 | 3 | 2 | 2 | 2 | 0 | 2 | 2 | 1 | 1 | 1 | ← 16 |

14

$$A \cdot B = \overset{18}{\begin{bmatrix} a_{11} & \cdots & a_{1M} \\ \vdots & a_{ij} & \vdots \\ a_{M1} & \cdots & a_{MM} \end{bmatrix}} \cdot \overset{20}{\begin{bmatrix} b_{11} & \cdots & b_{1M} \\ \vdots & b_{ij} & \vdots \\ b_{M1} & \cdots & b_{MM} \end{bmatrix}} = C = \overset{22}{\begin{bmatrix} c_{11} & \cdots & c_{1M} \\ \vdots & c_{ij} & \vdots \\ c_{M1} & \cdots & c_{MM} \end{bmatrix}}$$

$$\overset{22'}{=} \begin{bmatrix} a_{11}b_{11} + \cdots + a_{1M}b_{M1} & \cdots & a_{11}b_{1M} + \cdots + a_{1M}b_{MM} \\ \vdots & \vdots & \vdots \\ a_{M1}b_{11} + \cdots + a_{MM}b_{M1} & \cdots & a_{M1}b_{1M} + \cdots + a_{MM}b_{MM} \end{bmatrix}$$

FIG. 2.

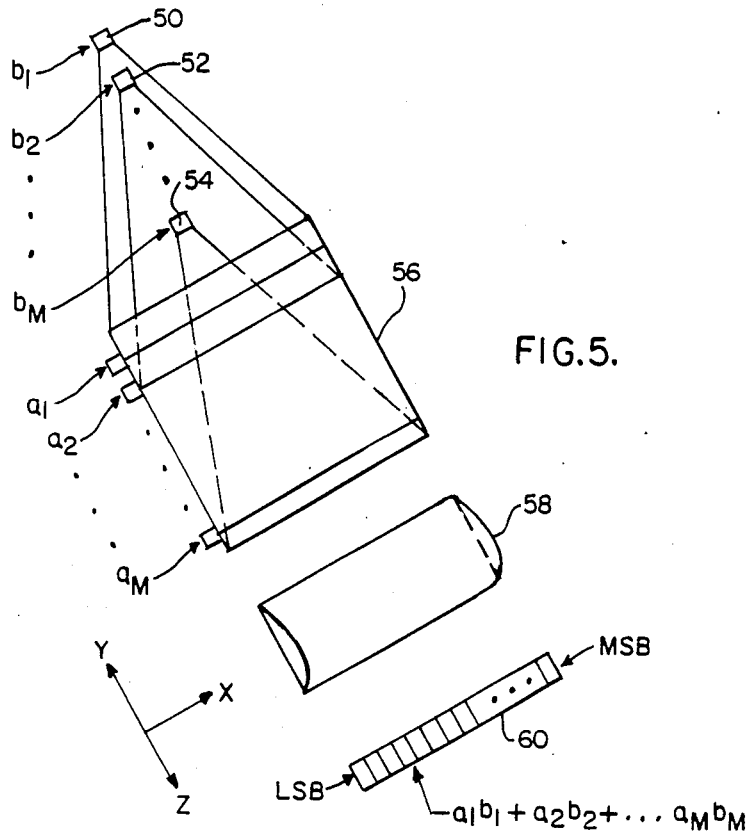

FIG.5.

SYSTOLIC TIME-INTEGRATING ACOUSTO-OPTIC BINARY PROCESSOR

BACKGROUND OF THE INVENTION

This invention relates, in general, to electrooptical signal processing and, more specifically, to acousto-optic processing of matrix and vector expressions.

Optical processors of various varieties have been disclosed in the prior art for matrix-vector and vector-vector multiplication, with their advantage being primarily in the speed of operation as compared to more typical digital electronic devices. Optical processors which use binary techniques offer better resolution than analog optical processors, which are usually only accurate to within seven to nine bits.

One method of binary optical processing makes use of algorithm of analog convolution and its extension to twos complement arithmetic. This method is based upon multiplying two binary numbers by convolving their bits. The result is in mixed binary form, thus different binary numbers can be added without the need for carries. This method is generally associated with matrices having only real-positive elements. However, extension to complex matrices is possible by partitioning the complex numbers into four unipolar parts. In order to reduce the matrix partitioning, it is helpful to use twos complement binary arithmetic which uses a sign bit for positive and negative numbers. Each binary product, including its sign bit, is represented in a mixed binary form so that different products can be added without the need for carries.

Implementation of the above-described technique based upon electro-optical engagement-array techniques have been proposed by others. However, such techniques require real-time, fast, and reusable two-dimensional reflecting valves which are expensive and in short supply.

Therefore, it is desirable, and it is an object of this invention, to provide a processing system which uses twos complement arithmetic without the hardware requirements of prior art systems.

The paper by R. P. Bocker, et al., published in *Applied Optics,* July 1983, pages 2019 to 2021, gives a description of twos complement arithmetic as applied to electro-optical matrix multiplication architectures. The paper by D. Casasent, published in *The Proceedings of the International Society for Optical Engineering,* August 1982, pages 50 to 58, describes acousto-optic processor architecture which is used for vector multiplication. Although similar to the invention disclosed herein, the systems disclosed in the referenced paper do not use a cylindrical lens or other space-integrating member to form the inner product on a single one-dimensional light detector array.

SUMMARY OF THE INVENTION

There is disclosed herein new and useful systems for matrix-matrix, matrix-vector, and vector-vector multiplication based upon inner product formation. According to one embodiment, a one-dimensional array of laser diodes is modulated by the element values of a vector in bit-serial form. The modulated light is imaged onto a two-dimensional acousto-optic cell which has a number of individual channels therein modulated in bit-serial form by element values of another vector. The resulting light is space-integrated by a cylindrical lens and focused onto a one-dimensional detector array. The detector array time-integrates the light signal and provides electrical outputs proportional to the amount of light seen by the detector over a period of time. The analog electrical signals are converted to digital format and applied to a shift register/accumulator for conversion from twos complement form to conventional binary form.

In another embodiment of the invention, a two-dimensional array of laser diodes is positioned to illuminate separate portions of a two-dimensional acousto-optic cell. The diodes are modulated in bit-serial form by element values from one vector, and separate channels in the acousto-optic cell are modulated by element values from another vector. The acousto-optic cell is arranged with the separate channels effectively connected in series so that binary data loaded into one channel propagates serially through the cell in the same channel. A cylindrical lens and a one-dimensional detector array are used to convert the twice modulated light signals into a complete inner product value.

BRIEF DESCRIPTION OF THE DRAWINGS

Further advantages and uses of this invention will become more apparent when considered in view of the following detailed description and drawings, in which:

FIG. 2 shows a general matrix-matrix multiplication result having inner product elements;

FIG. 5 is a single channel version of a processor constructed according to this invention.

DESCRIPTION OF THE PREFERRED EMBODIMENTS

Figures 1, 3:
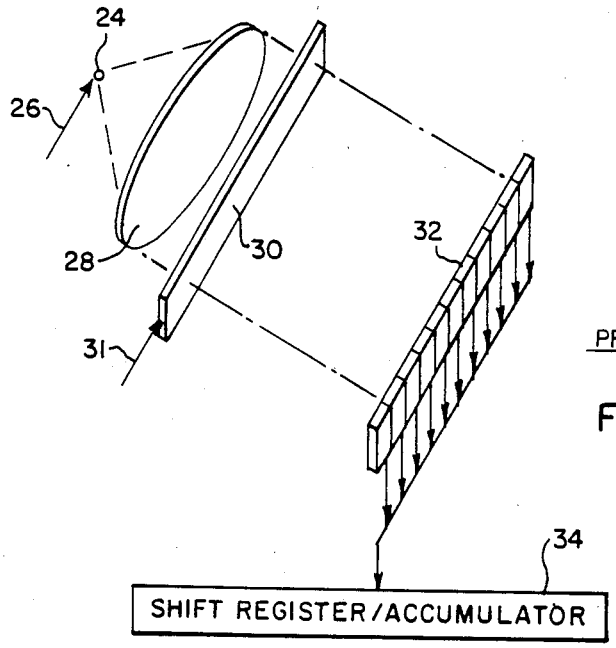
PRIOR ART FIG. 3.
FIG. 1 is a diagram illustrating twos complement multiplication of binary numbers.
FIG. 3 is a view showing an acousto-optic processor constructed according to the prior art.

Throughout the following description, similar reference characters refer to similar elements or members in all of the figures of the drawing.

The invention disclosed herein makes use of twos complement arithmetic and a thorough understanding thereof is helpful in following the description of this invention. Twos complement binary encoding represents a convenient method of handling both positive and negative numbers. To allow sign notation, the left most bit for each binary word is the sign bit, with 0 used for positive numbers and 1 for minus numbers. Positive binary number are represented by their original binary form, with the addition of the sign bit. For example, the integer +13 is represented by 01101. To represent a negative number, the sign bit is changed from 0 to 1, all of the bits except the sign bit are complemented, and a 1 is added. For example, the integer −45 is represented by 1010011.

For using twos complement arithmetic with the present invention, it is necessary that the binary representations of the numbers to be multiplied contain the same number of bits as the result. For example, multiplying +13 by −45 yields −585, which requires 11 bits to represent the product in twos complement binary form. To extend the input numbers to 11 bits, six zeros are inserted between the sign bit and the most significant bit (MSB) for the number +13, and four ones are inserted between the sign bit and the MSB for the number −45. Thus, the numbers to be multiplied have the binary form of 00000001101 and 11111010011 for +13 and −45, respectively.

With the numbers in 11 bit form, their product can be calculated by performing a sense multiplication and truncating any bits generated to the left of the sign bit column. An example of this procedure is shown in FIG. 1. As shown in FIG. 1, the binary representation 10 of +13 is multiplied by the binary representation 12 of −45. The intermediate binary representations 14 illustrate the truncating procedure and the result 16 is in mixed binary form. The result 16 is derived from normal addition of the bits in the intermediate representations 14. The result 16 can be converted to twos complement representation by repeatedly dividing the least significant mixed binary bit by modulus 2 and adding the quotient to the next bit. The remainders of these operations form a binary word which is the twos complement representation of the mixed binary number. If the mixed binary result is generated in the form of an analog signal, the device necessary for the conversion is an analog-to-digital converter (ADC) followed by a shift register/accumulator.

Mixed binary representation of numbers allows addition without the need for carries. For example, the mixed binary representation of −130 is 33332231110 and, as shown by result 16 in FIG. 1, the mixed binary representation of −45 is 33222022111. Adding each bit individually, without the need for carries, results in the mixed binary representation of 66554253221 which, when converted to twos complement form is 10100110101, or −585 in decimal form. By using twos complement arithmetic for optical processors, their accuracy is enhanced and they are capable of handling bipolar positive and negative numbers.

The invention disclosed herein uses inner product formulation methods to calculate a matrix-matrix product. A typical matrix-matrix multiplication is represented mathematically in FIG. 2. The A matrix 18 consists of general elements $a_{ij}$ and the B matrix 20 consists of the general elements $b_{ij}$. The resultant matrix 22 (C) consists of the general elements $c_{ij}$, and matrix 22' illustrates the form of the $c_{ij}$ elements. Each $c_{ij}$ element is an inner product between the ith row vector of matrix 18 and the jth column vector of matrix 20. As can be seen from matrix 22', each inner product is the summation of M element products where M denotes the dimension or rank of the matrix, i.e., the number of elements in a row or column. To obtain a complete column of matrix 22, it is necessary to calculate a matrix-vector product, or M inner products. Consequently, a full matrix-matrix multiplication can be considered as M matrix-vector products or M×M inner products.

The output or resultant is of such form that each time a vector-vector inner product is formed, one complete element of the output vector is generated. This feature, combined with the systolic array architecture of this invention, results in the parallel formation of M inner products, or a complete column of the resultant matrix. In such form, the matrix is well suited for interative algorithms which feed back one complete output element at a time.

If analog inputs are used, M output channels are required for the detection of the M inner products. When using binary encoding and bit-serial formation of the mixed binary bits, M output channels are needed. If the N output bits are formed in parallel, the number of output channels increases from M to N×M. The maximum possible value of the output is N×M which occurs when all N bits of the input elements have the logic value of one. In this case, the maximum possible value of each element product occurring at the sign bit is N. Thus, since each inner product is the summation of M element products, the maximum possible value of the sign bit of the inner product is N×M. To convert the maximum analog value to binary, an analog to digital converter of $\log_2(N\times M)$ bits is required.

The operation of the optical processor of this invention may be better understood by analyzing a basic module or subsystem of the invention. FIG. 3 illustrates a common time integrating acousto-optic processor representing such subsystem. The laser diode 24 is modulated by a signal 26 and the light emanating from the diode 24 is focused by the lens 28 onto the one-dimensional acousto-optic (AO) cell or device 30, although other forms of spatial light modulators may be used. Light impressed upon the AO cell 30 is modulated by the cell 30 according to the signal 31 and is detected by the detector 32. Once detected, the electrical signals from the array 32 are processed by the shift register/accumulator 34. The detector array 32 may consist of separate detectors which accumulate and store the light energy over a period of time as a charge in a capacitor, with the charge being strobed out of the device at the end of the accumulation period and converted to its equivalent voltage.

Figure 4:
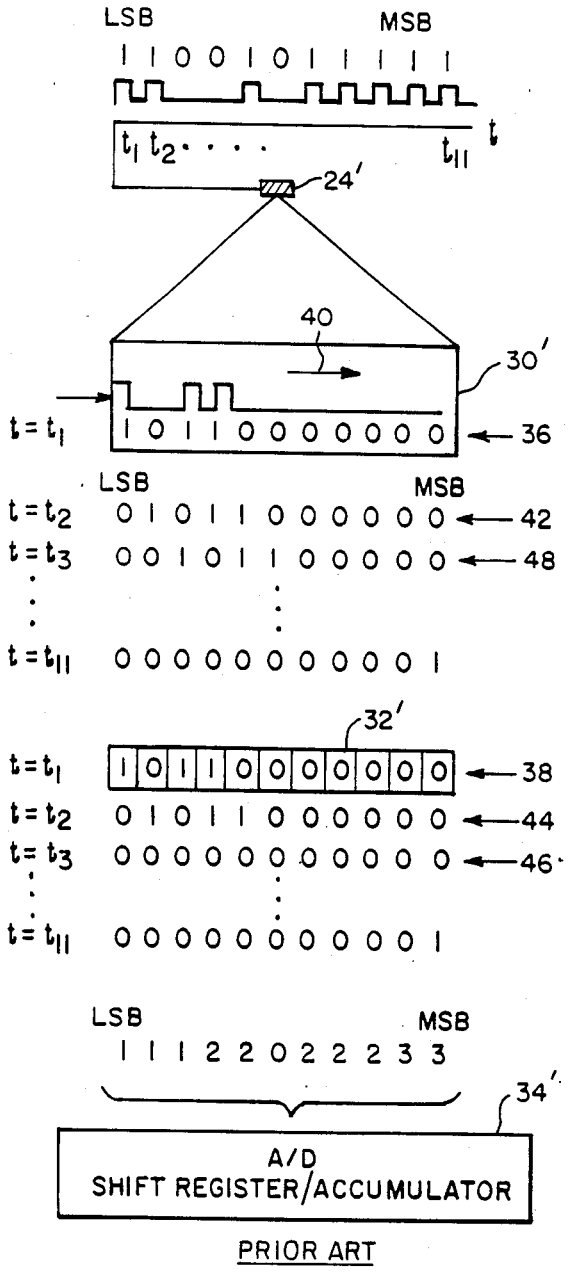
PRIOR ART FIG. 4.
FIG. 4 is a schematiac representation of the operation of the processor shown in FIG. 3.

FIG. 4 is a schematic representation of the system shown in FIG. 3. As an example, the operation of the system shown in FIG. 3 will be described for the formation of a single product of +13 and −45 by the twos complement method. The AO cell 30' is driven by the binary data A=+13 in a bit-serial mode. The sign bit is applied first. At time $t=t_1$, all of the bits that correspond to the number +13 have been loaded into the cell 30', as shown by the binary word 36. At time $t_1$, the binary data which corresponds to the number B=−45 is applied to the laser diode 24' in a bit-serial mode with the least significant bit (LSB) of the number being applied first. Therefore, at time $t_1$, the LSB is 1 and the diode 24' is illuminating the AO cell 30' with light.

The light passing through the AO cell 30' is schlieren imaged onto the time integrating linear detector array 32'. The array 32' consists of N elements, where N is the number of output bits, which is 11 in this description. The resulting light, shown by binary word 38, is time integrated by the detector array 32'.

At time $t=t_2$, the data in the AO cell 30' has shifted to the right as indicated by arrow 40 and by the binary word 42. The time necessary to shift the binary words is $T_B$, which is equal to $t_2-t_1$. In addition, $T_B$ corresponds to the time delay required for a bit plus an extra inserted zero to propagate through the AO cell 30'. At the same time between $t_1$ and $t_2$, the second bit of the number B is applied to the laser diode 24'. This is the LSB plus 1 and has a logic value of 1 in this specific example. Consequently, the new binary pattern represented by binary word 44 is seen by the detector array 32'.

The detector array 32' adds the new word pattern to the already existing pattern. A similar process repeats itself for time $t=t_3$ and a new pattern, as shown by binary word 46, is seen by the detector array 32'. Word 46 contains all zeros in this representation since the bit corresponding to time $t_3$ applied to the diode 24' is a zero. Consequently, with no light from the diode 24', no light reaches the detector array 32' even though the AO cell 30' contains both ones and zeros at time $t_3$, as shown by binary word 48. After time $t=t_{11}-t_1+T_B$, the 11th and last pattern is created and added. At this time, the values of the N elements of the detector array 32' are read out and the read out chart has a value which corresponds to the mixed binary form of the result (−585), namely 33222022111. These analog values are then converted into twos complement representation by the A/D shift register/accumulator 34'.

It is emphasized that each bit of serial data used to modulate either the diode 24' or the AO cell 30' is followed by a zero. This is necessary to separate, at the detector array, the different output bits since data A is moving as data B is being applied. In addition, the LSB of the data A is followed by 2N zeros of total duration $T=NT_B$. This is necessary to distinguish between different products. For example, if the LSB of data A is followed by the sign bit of data C, the output would be incorrect due to contributions from the product B×C.

The system described in connection with FIGS. 3 and 4 serves as a two-number multiplier. Extension to vector-vector multiplication by inner product formation can be achieved through the multi-unit system shown in FIG. 5. As shown in FIG. 5, the processor includes an array of M laser diodes, such as the diodes 50, 52 and 54, and an M-channel AO cell 56. The system also includes cylindrical lens 58 and an N-element one-dimensional detector array 60 located at the back focal plane and at position $f_y=0$.

The processor shown in FIG. 5 would be suitable for multiplying two of the vector quantities contained in the matrices shown in FIG. 2. For example, matrix 18 vector $a_{11} \ldots a_{1M}$ may be multiplied by matrix 20 vector $b_{11} \ldots b_{M1}$. For vector quantities, the extra subscript may be dropped to give the vectors $a_1 \ldots a_M$ and $b_1 \ldots b_M$. These vectors are applied to the processing system as indicated in FIG. 5. That is, each $a_i$ element for $i=1,2,\ldots,M$ of vector a drives or modulates a different channel of the AO cell 56. Also, each $b_i$ element for $i=1,2,\ldots,M$ of vector b drives or modulates a different diode, with the modulation timing of each section being similar to the one section described in connection with FIGS. 3 and 4.

Each section or channel of the system shown in FIG. 5 provides a product of the vector elements, or $a_ib_i$ for $i=1,2,\ldots,M$. Summation of these products produces the inner product of vector multiplicafion, namely, $a_1b_1+a_2b_2+\ldots+a_Mb_M$. Since the separate terms in the inner product are available from the system of FIG. 5 at the same time, summation thereof is accomplished by the spatial integrating properties of the cylindrical lens 58 which condenses or converges all of the light rays from each section onto the common detector array 60. This result is valid since the light coming from the AO cell 56 is in mixed binary form and may be summed without the need for carries. As previously described, the resulting pattern is time integrated by the N-element one-dimensional detector array 60 and applied to the A/D converter and to a shift register/accumulator.

Figure 6:
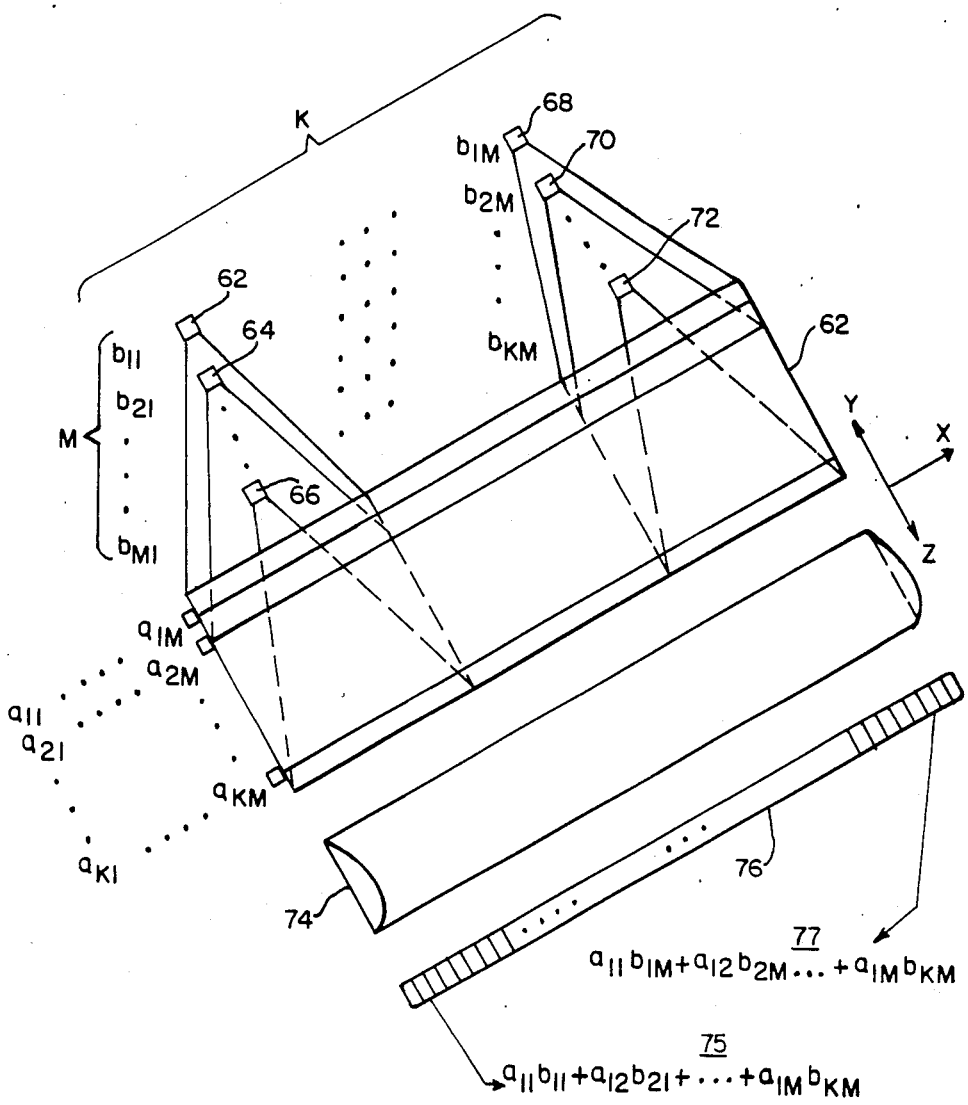
FIG. 6 is a systolic version of a processor constructed according to this invention.

FIG. 6 is a multichannel or systolic embodiment of the invention which uses the delay properties of a large aperture M-channel AO cell 62, and an M×K array of laser diodes, such as the diodes 62, 64, 66, 68, 70 and 72. The matrices being multiplied have dimensions of M by K. Different row vectors of one matrix are used to modulate the AO cell 62 along each of its separate channels in the X dimension. Different column vectors of the other matrix are used to modulate the laser diodes along the array channels in the Y dimension. The cylindrical lens 74 focuses the light coming from the AO cell 62 onto the N×K element detector array 76. Each section of the array 76, containing N detector elements, yields an inner product, such as the inner products 75 and 77 illustrated at each end of the detector array 76. This systolic processor, at peak operation, can provide, in parallel, K inner products formed by the space integrating property of the cylindrical lens 74 and by the time integrating property of the detector array 76.

The system of this invention, because of the algorithm used, is capable of forming highly accurate inner products between bipolar value vectors. The output array is N bits, which corresponds to a dynamic range of 20 log $(2^N)$. In order to fully utilize this accuracy, it is necessary to minimize possible detection errors which can be large because of the post processing stage where each mixed binary bit is effectively weighted by a power of two. It is thus desirable to limit the maximum value accumulated in the detector array, which is N×M, because, for minimum detection errors, the detector array should have a dynamic range of at least 10×M×N:1. This requirement effectively constrains both M and N. Currently available state-of-the-art detectors have a dynamic range of 35 db which allow for systems with N=M=16. A realistic system could have N=K=16 and M=8.

The throughput rate of the system of this invention depends highly upon the data loading rate, and the efficiency of the system depends upon the laser diode array and the post detection analog-digital converters. Using currently available components, the system can form eight inner products with 16-bit accuracy. This can be done with a throughput rate of $10^9$ M−A/sec with an efficiency of $<100\times10^6$ M−A/sec·W.

Additional description of the preferred embodiment of this invention is contained in a paper by the inventor published in *Applied Optics*, November 1984, pages 4095 to 4099.

It is emphasized that numerous changes may be made in the above-described system. Since different embodiments of the invention may be made without departing from the spirit thereof, it is intended that all of the matter contained in the foregoing description, or shown in the accompanying drawings, shall be interpreted as illustrative rather than limiting.

I claim as my invention:

1. An optical processing system for forming inner product values from element values of first and second vectors, said system comprising:

a plurality of one-dimensional spatial light modulators;

means for separately illuminating each of said spatial light modulators with modulated coherent light;

first means for modulating said illuminating means with element data from said first vector, wherein said first modulating means modulates the illuminating means with data in twos complement form;

second means for modulating said spatial light modulators with element data from said second vector, wherein said second modulating means modulates the spatial light modulator with data in twos complement form;

means for spatially integrating the light from all of the spatial light modulators into a substantially one-dimensional integrated light array;

means for time integrating said one-dimensional integrated light array and for converting the time integrated light into electrical signals, wherein each bit of the element value used by said first modulating means sequentially controls the output state of said illuminating means during a predetermined time period, and wherein the light output from said illuminating means illuminates a spatial light modulator containing all of the bits of the vector element value during said predetermined time period; and an analog-to-digital converter and a shift register/accumulator for converting said electrical signals into binary values, wherein said analog-to-digital converter has a bit accuracy which is equal to the bit accuracy of the element data from said first and second vectors.

2. The optical processing system of claim 1 wherein the spatially integrating means includes a cylindrical lens.

3. The optical processing system of claim 1 wherein the time integrating and converting means includes a multi-element, one-dimensional detector array.

4. The optical processing system of claim 3 wherein the number of elements in the detector array is equal to the number of bits of resolution of the inner product.

5. The optical processing system of claim 1 wherein the illuminating means includes an array of separate light emitting devices positioned along a first dimension.

6. The optical processing system of claim 5 wherein the one-dimensional spatial light modulators extend along a second dimension, with said second dimension being at right angles to said first dimension.

7. The optical processing system of claim 1 wherein the spatial light modulators are separate acousto-optic cells aligned in the same direction.

8. The optical processing system of claim 1 wherein the spatial light modulators are separate channels in a multichannel two-dimensional acousto-optic cell.

9. The optical processing system of claim 1 wherein a plurality of said processing systems are arranged in parallel to process more than one inner product simultaneously, with the spatial light modulators in adjacent systems being effectively connected in series so that binary data loaded into a spatial light modulator in one system propagates serially through the corresponding spatial light modulators in the other systems.

10. An optical processing system for forming inner product values from element values of first and second vectors, said system comprising:

a two-dimensional acousto-optic cell;

a two-dimensional array of coherent light sources having a plurality of individually controllable light sources each positioned to illuminate a separate portion of said acousto-optic cell;

a one-dimensional time integrating converter for changing light signals into electrical signals;

a cylindrical lens for spatially integrating the light from all of the separate portions of the acousto-optic cell and for directing the spatially integrated light onto said time integrating converter;

means for modulating each controllable light source sequentially with each bit of a first binary element value during a predetermined time period; and means for modulating each portion of said acousto-optic cell with all of the bits of a second binary element value during said predetermined time period;

with the separate acousto-optic cell portions being arranged serially so that the bit data modulating one portion propagates into the adjacent portion.

11. A method for forming the inner product values from element values of first and second vectors, said method comprising the steps of:

modulating light sources in bit-serial form by an element value from said first vector;

imaging the modulated light source signals onto an acousto-optic cell;

modulating said acousto-optic cell in bit-serial form by the element value from said second vector;

spatially integrating the light from said acousto-optic cell;

time integrating the spatially integrated light; and converting the time and space integrated light into digital electrical signals.

* * * * *